United States Patent [19]

Inagaki

[11] Patent Number: 4,630,361

[45] Date of Patent: Dec. 23, 1986

[54] PROCESS FOR PREPARING A VACUUM SWITCH TUBE

[75] Inventor: Kouichi Inagaki, Itami, Japan

[73] Assignee: Mitsubishi Denki Kabushiki Kaisha, Tokyo, Japan

[21] Appl. No.: 662,152

[22] Filed: Oct. 18, 1984

[30] Foreign Application Priority Data

Oct. 24, 1983 [JP] Japan ..... 58-198652
Mar. 6, 1984 [JP] Japan ..... 59-43134

[51] Int. Cl.[4] ..... H01H 11/00

[52] U.S. Cl. ..... 29/622; 200/144 B; 228/221

[58] Field of Search ..... 29/622; 200/144 B; 228/221; 445/43

[56] References Cited

U.S. PATENT DOCUMENTS

| | | | |
|---|---|---|---|
| 3,633,267 | 1/1972 | Kent et al. | 228/221 |
| 3,656,225 | 4/1972 | Bereza | 228/221 |
| 4,077,114 | 3/1978 | Sakuma | 29/622 |

FOREIGN PATENT DOCUMENTS

| | | | |
|---|---|---|---|
| 645871 | 6/1937 | Fed. Rep. of Germany . | |
| 1104623 | 4/1968 | Fed. Rep. of Germany . | |
| 2044277 | 6/1971 | Fed. Rep. of Germany . | |
| 134693 | 3/1979 | German Democratic Rep. . | |
| 55-69921 | 5/1980 | Japan . | |
| 17538 | 1/1982 | Japan | 445/43 |
| 45075 | 3/1984 | Japan | 228/221 |
| 441469 | 1/1968 | Switzerland . | |
| 1504666 | 3/1978 | United Kingdom . | |

*Primary Examiner*—Howard N. Goldberg
*Assistant Examiner*—P. W. Echols
*Attorney, Agent, or Firm*—Oblon, Fisher, Spivak, McClelland, & Maier

[57] ABSTRACT

A pre-assembled vacuum switch tube having a clearance between a stationary electrode rod and end plate is firstly prepared by forming an enlarged diameter part in the stationary electrode rod at a position where the rod extends from the end plate to the outside of the vacuum envelope and by arranging at least one piece of plate-like brazing material having a flat surface. The pre-assembled vacuum switch tube is put into a vacuum furnace; the interior of the vacuum switch tube is evacuated through the clearance; temperature in the furnace is elevated to melt the brazing material thereby causing the descending of the enlarged diameter part due to the dead weight of the stationary electrode rod and the vacuum switch tube is sealed by bonding of the end plate and the rod. Alternatively, the clearance is formed in such a manner that a supporting member having a through hole into which the enlarged diameter part of the stationary electrode rod is inserted is placed on the end plate and at least one piece of plate-like brazing material is arranged between the supporting member and the enlarged diameter part of the stationary electrode rod.

13 Claims, 15 Drawing Figures

PROCESS FOR PREPARING A VACUUM SWITCH TUBE

BACKGROUND OF THE INVENTION

The present invention relates to a process for preparing a vacuum switch tube.

A vacuum switch tube is generally constructed in such a manner that a pair of electrodes is received in a vacuum envelope made of an insulating material so as to be connectable and separable with respect to each other by the movement of a bellows and the vacuum envelope is sealed under vacuum condition.

In the conventional process of preparing a vacuum switch tube, sealing of a vacuum switch tube has been conducted after exhausting air from an exhaust tube. Recently, there has been proposed such a method that brazing is carried out under a vacuum condition without using the exhaust tube. It is mainly because (1) the tip of the exhaust tube, being relatively weak, may be damaged during manufacturing steps of the vacuum switch tube, (2) presence of the exhaust tube prevents easy assembly when the vacuum switch tube is assembled into a current interrupter and (3) brazing operation under vacuum condition reduces the number of manufacturing steps because baking and sealing operations are simultaneously done.

As a process for preparing a vacuum switch tube without having an exhaust tube, it has been known to use a process in which a pre-assembled vacuum switch tube is put into a vacuum brazing furnace; the interior of the furnace is brought to a pressure of $10^{-4}$ Torr or less and a temperature of 400° C.–600° C. whereby air in the pre-assembled vacuum tube is evacuated through a clearance formed by the provision of a brazing material and then the brazing material is melted at a brazing temperature to accomplish the bonding operation by brazing; thus the vacuum switch tube is sealed.

In this case, there a rises a problem of the structure of an air exhausting part. Though an air exhausting passage is formed by a clearance formed near a brazing material put in a pre-assembled vacuum switch tube, if air-exhausting resistance is high at the clearance, the interior of the vacuum switch tube can not be brought to a high vacuum condition. Various attempts have been made to improve the exhausting of air from the vacuum switch tube. However, these attempts fail to sufficiently reduce the resistance of the air exhaust thereby being inacceptable in practical use.

Further, although there was an attempt to reduce air-exhausting resistance by providing a corrugated plate of brazing material to form a clearance in a portion to be brazed, the corrugated plate was apt to collapse and be deformed during assembling operation.

SUMMARY OF THE INVENTION

It is an object of the present invention to provide a process for preparing a vacuum switch tube for reducing air-exhausting resistance by improving a structure of an air exhausting part of the tube without using an air exhaust tube.

It is another object of the present invention to provide a process for preparing a vacuum switch tube which is highly reliable and sealed under a highly vacuumed condition.

The foregoing and the other objects of the present invention have been attained by providing a process for preparing a vacuum switch tube comprising a vacuum envelope having both ends closed by end plates in which a stationary electrode and a movable electrode are placed opposing each other and an electric path is opened and closed by the connection and disconnection of the electrodes, wherein a pre-assembled vacuum switch tube having a clearance between a stationary electrode rod attached with the stationary electrode and one of the end plates is prepared by forming an enlarged diameter part in the stationary electrode rod at a position where the rod extends from one of the end plates to the outside of the vacuum envelope and by arranging at least one piece of plate-like brazing material between the enlarged diameter part and the end plate, and the pre-assembled vacuum switch tube is put into a vacuum furnace, followed by evacuating air and raising the temperature of the vacuum furnace to connect the stationary electrode rod and the end plate by melt-bonding the brazing material.

BRIEF DESCRIPTION OF THE DRAWINGS

A more complete appreciation of the invention and many of the attendant advantages thereof will be readily obtained as the same becomes better undertood by reference to the following detailed description when considered in connection with the accompanying drawings, wherein.

DETAILED DESCRIPTION OF THE PREFERRED EMBODIMENTS

An embodiment of the present invention will be described with reference to the drawings.

Figure 1:
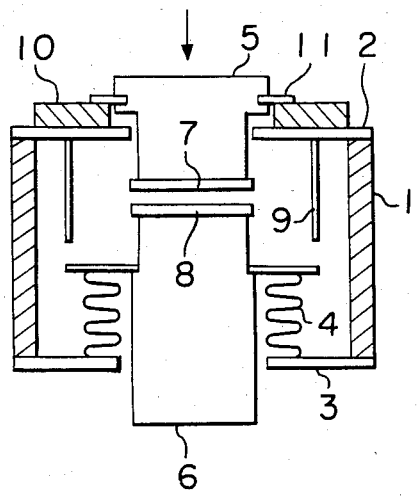
FIG. 1 is a cross-sectional view of an embodiment of a process for preparing a vacuum switch tube according to the present invention.

In a vacuum switch tube shown in FIG. 1, a reference numeral 1 designates a vacuum envelope formed of an insulating material, a numeral 2 designates a stationary side end plate, a numeral 3 designates a movable side end plate, a numeral 4 designates a bellows, a numeral 5 designates a stationary electrode rod, a numeral 6 designates a movable electrode rod, a numeral 7 designates a stationary electrode attached to the stationary electrode rod 5 and a numeral 8 designates a movable electrode attached to the movable electrode rod 6. An annular shielding plate 9 is connected to the stationary side end plate 2 to prevent contamination of the inner surface of the vacuum envelope 1 by metal vapor scattered from the electrodes 7, 8 at the time of opening and closing electric current. The bellows 4 is provided between the movable side end plate 3 and the movable electrode rod 6 whereby the electrodes 7, 8 are connected to and disconnected from each other while a vacuum condition is kept in the vacuum envelope.

Figure 2:
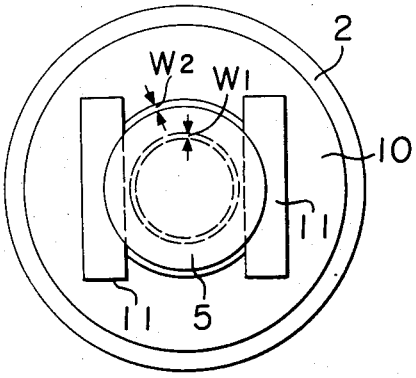
FIG. 2 is a plane view showing the arrangement of a brazing material used in the present invention.

In the vacuum switch tube constructed as abovementioned, an exhaust port to sufficiently exhaust air from the tube is formed in such a manner that an engaging part in a form of a recess is formed in an enlarged diameter part of the stationary electrode rod 5, two pieces of plate-like brazing material 11 having a flat surface are arranged at a supporting member 10 placed outside the vacuum envelope 1 with respect to the stationary side end plate 2 thereby to form a space between the stationary electrode rod 5 and the end plate 2. In this case, the two plate-like brazing materials are placed in a part of the circular portion of the stationary electrode rod so as not to close an exhaust port as shown in FIG. 2 which is a plane view of the vacuum switch tube as seen view from the arrow mark in FIG. 1.

The exhaust port is constituted by a clearance $W_1$ formed between the stationary electrode rod 5 and the stationary side end plate 2 and a clearance $W_2$ which is communicated with the clearance $W_1$ and is formed between the stationary electrode rod 5 and the supporting member 10 and is not occupied by the brazing material.

With the construction described above, when the vacuum switch tube is put in a vacuum brazing furnace and air in the furnace is evacuated, gas remaining in the vacuum switch tube is completely exhausted through the exhaust port. Further, when the temperature in the furnace is elevated sufficiently to melt the brazing material 11, the stationary electrode rod 5 descends due to its dead weight and the enlarged diameter part of the stationary electrode rod 5 is bonded to the stationary side end plate 2 by molten brazing material 11.

It is easy to prepare a flat plate made of brazing material and the construction with use of the plate-like brazing material sufficiently reduces resistance to the exhausting of air whereby it is possible to provide a highly vacuumed condition and a sufficient sealing operation.

The supporting member 10, made of ceramics or carbon which has no bonding property to a brazing material, can be easily removed after completion of evacuating and sealing operations and allows its reuse as a jig.

Figure 3A:
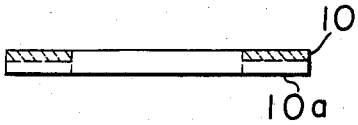
FIGS. 3A and 3B show a structure of an example of a supporting member of the present invention.
Figure 3B:
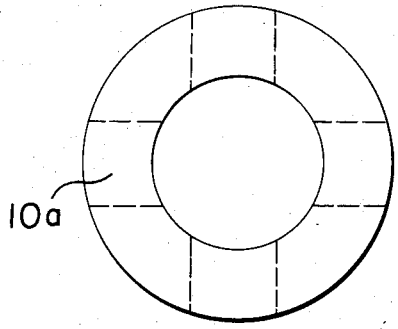
Figure 4:
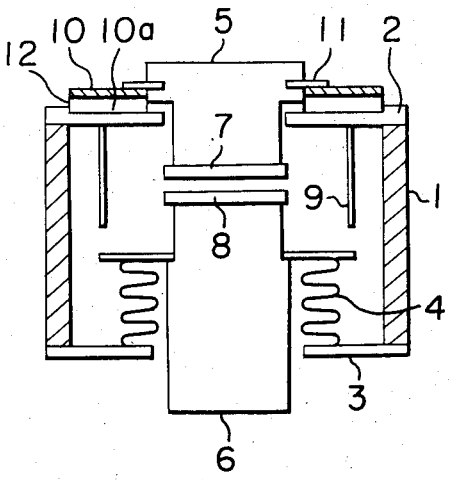
FIGS. 4–13 are plane views and sectional views showing other embodiments of the present invention.

FIG. 3A and FIG. 3B show respectively a cross-sectional view and a plane view of an embodiment of the supporting member 10 in which four exhausting ports 10*a* are formed in the radial direction. The provision of the exhaust ports 10*a* further reduces the air exhausting resistance in comparison with the embodiment shown in FIG. 2. In this case, the brazing material 11 as shown in FIG. 2 may be used. Further, an embodiment as shown in FIG. 4 may be utilized so as to make a determination of the position between the stationary electrode rod 5 and the end plate 2 easy. Namely, a fitting part 12 is formed either in the end plate 2 or the supporting member 10 and the enlarged diameter part of the stationary electrode rod 5 is fitted to the supporting member 10. The embodiment shown in FIG. 4 provides easy determination of position in comparison with the embodiments shown in FIGS. 1 and 2. In this case, exhausting of air can be sufficiently performed by the exhausting ports 10*a* of the supporting member 10.

Figure 5:
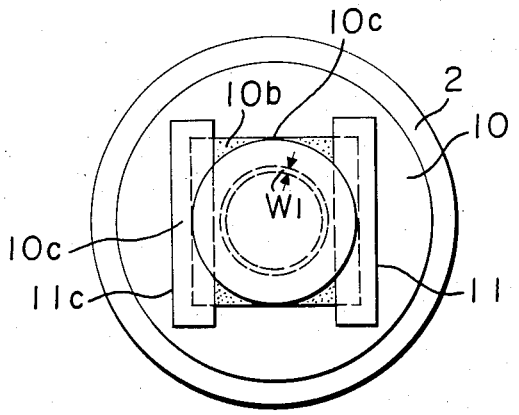

In an embodiment as shown in FIG. 5, a polygonal hole is formed in the supporting member 10 so that an exhaust port is constituted by spaces 10*b* produced between the enlarged diameter part of the stationary electrode rod 5 and the polygonal hole and a clearance $W_1$ formed between the stationary electrode rod 5 and the end plate 2. In this embodiment, determination of position can be easily performed by bringing the enlarged diameter part of the stationary electrode rod 5 in contact with the supporting member 10 at contacting areas 10*c*.

Figure 6:
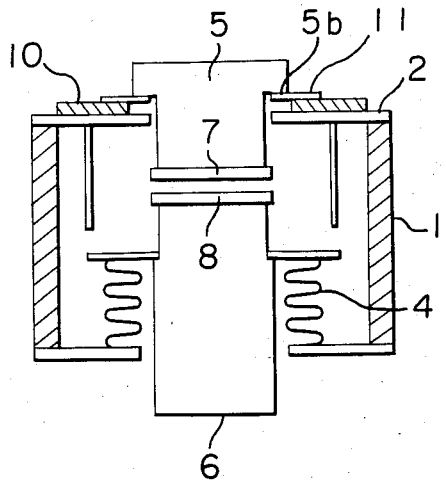

FIG. 6 shows another embodiment in which the lower surface of the enlarged diameter part of the stationary electrode rod 5 is used as an engaging part 5*b* and flat plates of a brazing material 11 are arranged between the engaging part 5*b* and the supporting member 10 to form a clearance between the stationary electrode rod 5 and the end plate 2. In this case, the manufacturing cost of the vacuum switch tube is reduced because it is unnecessary to provide a recess in the enlarged diameter part of the stationary electrode rod 5.

Figure 7A:
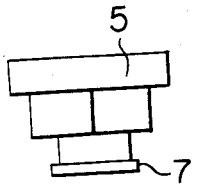
Figure 7B:
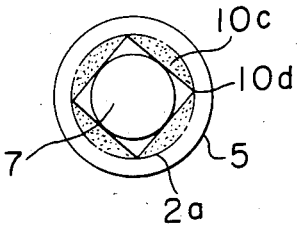

FIGS. 7A and 7B are respectively a front view and a plan view of an embodiment of the stationary electrode rod 5 in which a rectangular portion is formed between the enlarged diameter part and the stem of the stationary electrode 7. A numeral 2*a* designates a hole formed in the end plate 2. Air-exhausting is conducted through spaces 10*c* formed by the end plate and the rectangular part of the stationary electrode rod 5. Further, determination of position can be easily performed by use of contacting portions 10*d* between the end plate and the rectangular part. A polygonal shape other than the rectangular shape may be utilized for the stationary electrode rod. Alteruatively, projections may be provided in the stationary electrode rod 5.

Also, though the embodiments shown in FIGS. 1 to 6 use the supporting member 10 to support the brazing material 11, the supporting member 10 can be eliminated in the embodiment shown in FIG. 7.

Figure 8:
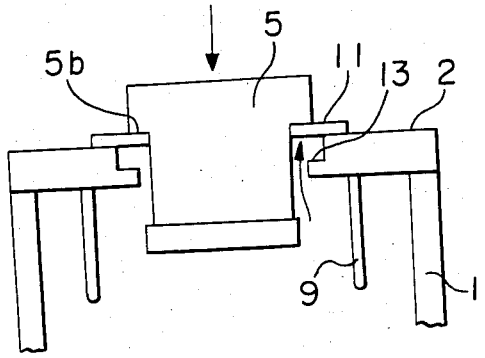

The supporting member 10 can be also eliminated in an embodiment as shown in FIG. 8.

Figure 9:
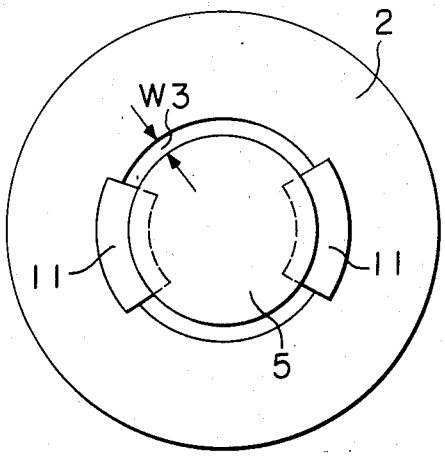

FIG. 9 is a plan view of this embodiment. The stationary electrode rod 5 is placed with its engaging part 5*b* supported by the brazing material 11 while keeping a clearance at the end plate 2. Air-exhausting is conducted through a clearance $W_3$ formed between the stationary electrode rod 5 and an annular stepped portion 13 formed in the end plate 2. When heat is applied to the brazing material to melt it after exhausting of air, the diameter part of the stationary electrode rod 5 descends and then, the engaging part 5*b* of the lower surface of the enlarged diameter part is connected to the stepped portion 13 of the end plate by brazing. Though the brazing material 11 is not provided around the entire region of the clearance as shown in FIG. 9, the brazing material spreads along the circumference when molten, whereby the stationary electrode rod 5 is blazed to the end plate 2 without any gap.

Figure 10:
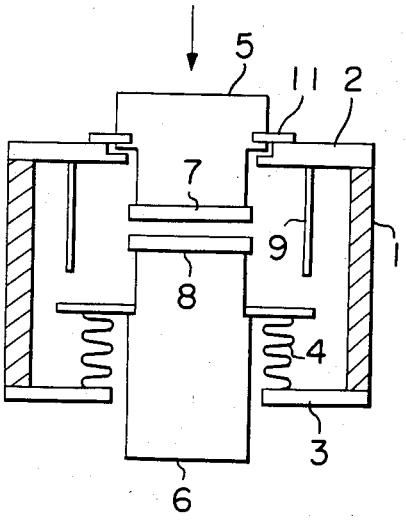
Figure 11:
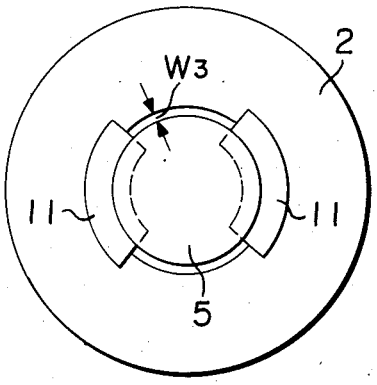

FIG. 10 is a cross-sectional view of an embodiment of the vacuum switch tube without the supporting member and FIG. 11 is a plane view of this embodiment. Recesses are formed in the enlarged diameter part of the stationary electrode rod 5 at diametrically opposing positions and brazing material is put in each of the recesses to support the stationary electrode rod 5 by the stationary side end plate 2 whereby an exhaust port is provided by a clearance $W_3$ between the enlarged diameter part and the stationary side end plate 2.

Figure 12:
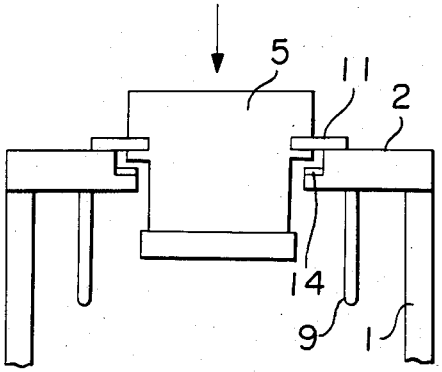
Figure 13:
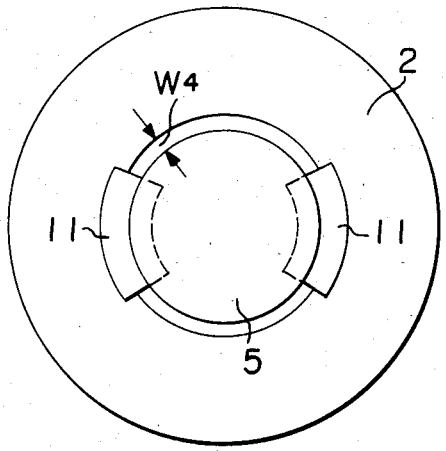

FIG. 12 shows still another embodiment in which a larger clearance is formed for air-exhausting, namely, a ringed thin plate-like brazing material 14 is arranged, as an auxiliary brazing material, at a position where the stationary side end plate 2 and the stationary electrode rod 5 are connected by brazing. In this case, connection by brazing becomes reliable and relatively small pieces of brazing material 11 can be used. Accordingly, a clearance $W_4$ for air-exhausting greater than the clearance $W_3$ can be provided as shown in the plane view of FIG. 13.

In the above-mentioned embodiments, one or more brazing materials can be used so long as a sufficient exhaust port can be provided and reliable connection by brazing can be attained.

As described above, in accordance with the present invention, an economical and reliable vacuum switch tube providing a highly vacuum condition can be prepared by improving a construction of an air exhausting part to reduce the resistance of exhausting air.

I claim:

1. A process for preparing a vacuum switch tube having a vacuum envelope having both ends closed by end plates in which a stationary electrode and a movable electrode are placed opposing each other and an electric path is opened and closed by the connection and disconnection of said electrodes, comprising the steps of:

providing a pre-assembled vacuum switch tube having a clearance between an opening of one of said end plates of said vacuum envelope and a stationary electrode rod passing through said opening and connected to said stationary electrode;

forming an enlarged diameter part in said stationary electrode rod at a position where said rod extends outside of said one of the end plates to the outside of said vacuum envelope;

forming a step at said opening of said one of said end plates;

spacing said enlarged diameter part from said one of said end plates by arranging at least one piece of non corrugated plate-like brazing material between said enlarged diameter part and radially outer portion of said step at said end plate over less than the entire length of said clearance;

putting said pre-assembled vacuum switch tube into a vacuum furnace; and evacuating air and raising temperature in said vacuum furnace to connect said stationary electrode rod to said end plate by melt-bonding said brazing material.

2. The process for preparing a vacuum switch tube according to claim 1, when said step of forming said step includes positioning a supporting member through which the enlarged dimater part of said stationary electrode rod extends on said end plate of said vacuum envelope, wherein said at least one piece of plate-like brazing material is arranged between said supporting member and the enlarged diameter part of said stationary electrode rod to thereby form a clearance between said stationary electrode rod and said end plate.

3. The process for preparing a vacuum switch tube according to claim 2, including the steps of providing a recess in said enlarged diameter part of said stationary electrode rod, and using said recess as an engaging part for said brazing material.

4. The process for preparing a vacuum switch tube according to claim 2, including the step of using the lower surface of the enlarged diameter part of said stationary electrode rod as an engaging part for said brazing material.

5. The process for preparing a vacuum switch tube according to claim 2, including the step of providing an exhaust port in said supporting member, said exhaust port extending from an inner diameter part to an outer diameter part of said supporting member.

6. The process for preparing a vacuum switch tube according to claim 5, including the steps of fitting said supporting member to said end plate and fitting the enlarged diameter part of said stationary electrode rod to said supporting member.

7. The process for preparing a vacuum switch tube according to claim 2 including the steps of forming a polygonal hole in said supporting member and forming said stationary electrode rod to be circular in cross section.

8. The process for preparing a vacuum switch tube according to claim 2 including the steps of forming a circular hole in said supporting member and forming said stationary electrode rod to be polygonal in cross section.

9. The process for preparing a vacuum switch tube according to claim 2, including the step of selecting said supporting member to be made of a material from a group consisting of ceramics and carbon.

10. The process for preparing a vacuum switch tube according to claim 1, including the step of forming a recess in the enlarged diameter part of said stationary electrode rod and using said recess as an engaging part for said brazing material.

11. The process for preparing a vacuum switch tube according to claim 1, including a the step of using an end surface of the enlarged diameter part of said stationary electrode rod as an engaging part for said brazing material.

12. The process for preparging a vacuum switch tube according to claim 1, including the step of forming said step in said one of said end plates.

13. The process for preparing a vacuum switch tube according to claim 1 including the step of arranging said brazing material in said step formed at said one of said end plates.

* * * * *